US005199218A

United States Patent [19]

McQuade

[11] Patent Number: 5,199,218

[45] Date of Patent: Apr. 6, 1993

[54] GATE HINGE

[76] Inventor: Donald E. McQuade, 56 Jefferson St., Redbank, N.J. 07701

[21] Appl. No.: 641,873

[22] Filed: Jan. 4, 1991

[51] Int. Cl.[5] ..... E05D 15/00

[52] U.S. Cl. ..... 49/381; 16/379; 16/390; 16/392; 49/398

[58] Field of Search ..... 49/381, 398; 16/390, 16/392, 379; 256/59

[56] References Cited

U.S. PATENT DOCUMENTS

| | | | |
|---|---|---|---|
| 183,503 | 10/1876 | McEntire | 49/381 |
| 1,020,019 | 3/1912 | Boone | 49/381 |
| 1,249,516 | 12/1917 | Schell | 49/398 X |
| 1,573,231 | 2/1926 | Economides | 16/390 X |
| 2,027,724 | 1/1936 | Etzel | 49/398 |
| 2,133,663 | 10/1938 | Johnson et al. | 16/379 |

*Primary Examiner*—Philip C. Kannan

*Attorney, Agent, or Firm*—Weingram & Zall

[57] ABSTRACT

A hinge for mounting a wooden gate to a wooden fence post. This hinge features a protected pivot point so as to minimize deterioration of the pivot point by weathering, lips that coact with the fence post so as to counter act gate sagging over time and thus maintain the gate in a square orientation and a design that limits the gate opening or swing to one direction only. The hinge is comprised of a non-moving stirrup member mounted in a notch cut into the fence post and a moving stirrup member that is attached to the gate. The pivot pin of the hinge is mounted within a notch in the fence post so that it is protected from the elements. The notch in the fence post also supports the non-moving stirrup member of the hinge so as to minimize gate sagging. The simplicity of the hinge design provides a gate hinge that is inexpensive to manufacture and simple to assemble and install.

11 Claims, 4 Drawing Sheets

GATE HINGE

BACKGROUND OF THE INVENTION

1. Field of the Invention

This invention relates to gate hinges in particular to gate hinges for wooden gates for fences which provide enhanced stability, endurance and usability over the life of the gate and fence.

2. Prior Art

Gate hinges, in particular wooden gate hinges are well known in the art. Typically these may be "T" hinges, screw hook and strap hinges, bolt hook and strap hinges, double strap hinges, "H" hinges, and screw hook and "I" hinges. These type hinges are well known in the art. Typically, one end of the hinge, i.e. the non-movable part, is attached to the wooden post and the other end of the hinge, i.e. the movable part, is attached to the wooden gate. Typically a pivot pin connects the movable part with the non-movable part permitting the gate to pivot to an open and closed position on the wooden post.

There are numerous problems associated with the known hinges. These hinges, because they are on outdoor gates, are exposed to the elements. This causes rust to develop and moisture, leaves, dirt, etc. to accumulate on the hinge, particularly around the pivot point, e.g. pin, causing deterioration thereof. Additionally, a wooden gate is a relatively heavy structure and over a period of time any weakness in the hinge and mounting means causes the gate to sag. In order to correct this condition the hinges must be replaced. This often requires the complete replacement of the post and gate due to the deterioration of the area around the hinges.

U.S. Pat. Nos. uncovered relating to this area of technology are:

74,805 to Dennis
189,866 to Long
246,281 to Atwood
418,021 to Harris
746,142 to Parkinson
869,905 to Holden
880,340 to Stetler
1,162,311 to Rowe
1,253,655 to Wiederrecht
1,640,525 to Belliveau In particular, Harris, U.S. Pat. No. 418,021, describes a hinge wherein a part of the hinge (A) is designed to be secured to a fixed support (J) and a part (B) is arranged to be secured to a moveable or adjustable part, e.g. door. Part (B) is provided with a shank (E) having an eye (F) which fits over a pin (D). Part (A) is surrounded by the fixed support (J) and part (B) is surrounded by door (I).

Because the pivot pin in Harris is enclosed by and centered between the sides, in order to have free movement of the gate, the face of the moveable part must be concave requiring special machining or molds. Such machining or molds are not conducive to inexpensive mass produced hinges.

Harris does not teach or suggest the use of such a hinge with a wooden fence nor some of the other advantages attained with Applicant's claimed invention.

Belliveau, U.S. Pat. No. 1,640,525, describes a hinge formed from two pieces of sheet metal wherein the sockets (6) and (3) (See FIG. 3 of Belliveau) are held together with a pin (12). The socket and pin are exposed to the elements and the problems associated with the known wooden gate hinges can be expected.

OBJECTS AND SUMMARY OF THE INVENTION

It is an object of this invention to provide a gate hinge for a wooden fence having enhanced stability, strength, and durability.

It is a further object of this invention to provide a gate hinge which during use prevents the sagging of heavy wooden gates.

It is still a further object of this invention to provide a gate hinge for a wooden fence wherein the pivot point or pin upon which the hinge pivots is protected from the elements.

It is still a further object of this invention to provide a fence opening having a wooden fence post, a gate and a gate hinge wherein the pin upon which the hinge pivots is supported and enclosed by the post upon which the non-movable element is supported.

It is still a further object of this invention to provide a gate hinge which is inexpensive to manufacture and relatively simple to assemble.

It is still a further object of this invention to provide a gate hinge which permits the gate to swing in only one direction, a direction which may be selected prior to installation of the hinge.

This invention provides a gate hinge assembly comprising a wooden fence post; a gate hingeably mounted to the post by at least one gate hinge; the gate hinge including a non-movable part pivotally connected about a pivot point, to a movable part, the non-movable part mounted to the post such that the pivot point is within the post and the movable part mounted to the gate.

The gate hinge of this invention preferably comprises a first stirrup member for mounting on the post. This stirrup member has a lip on the top thereof and a lip on the bottom thereof facing away from the post and a pivot pin traversing these lips. A second stirrup member is provided for mounting to the wooden gate. This stirrup member has a post projecting from the end thereof, the post having an eye which surrounds and pivots on the pin. The first stirrup member is mounted on to the post such that the lips and pivot pin are surrounded by and enclosed within the post. Preferably the pivot pin and eye are offset to one side of the post to permit the gate to open in one direction and not in the other.

DETAILED DESCRIPTION OF THE INVENTION

Figure 1:
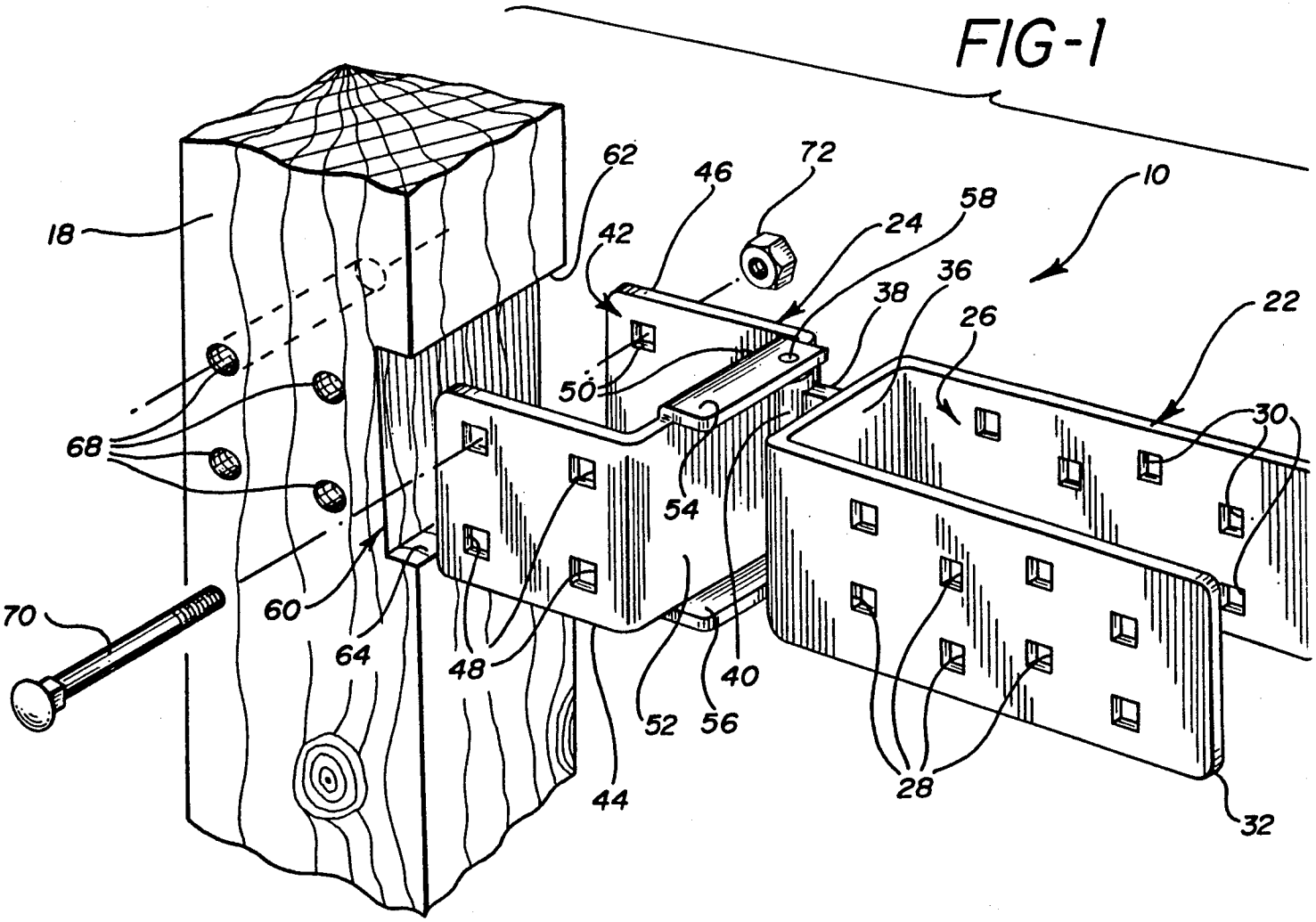
FIG. 1 is a perspective view of the gate hinge of this invention prior to installation on a wooden post.
Figure 2:
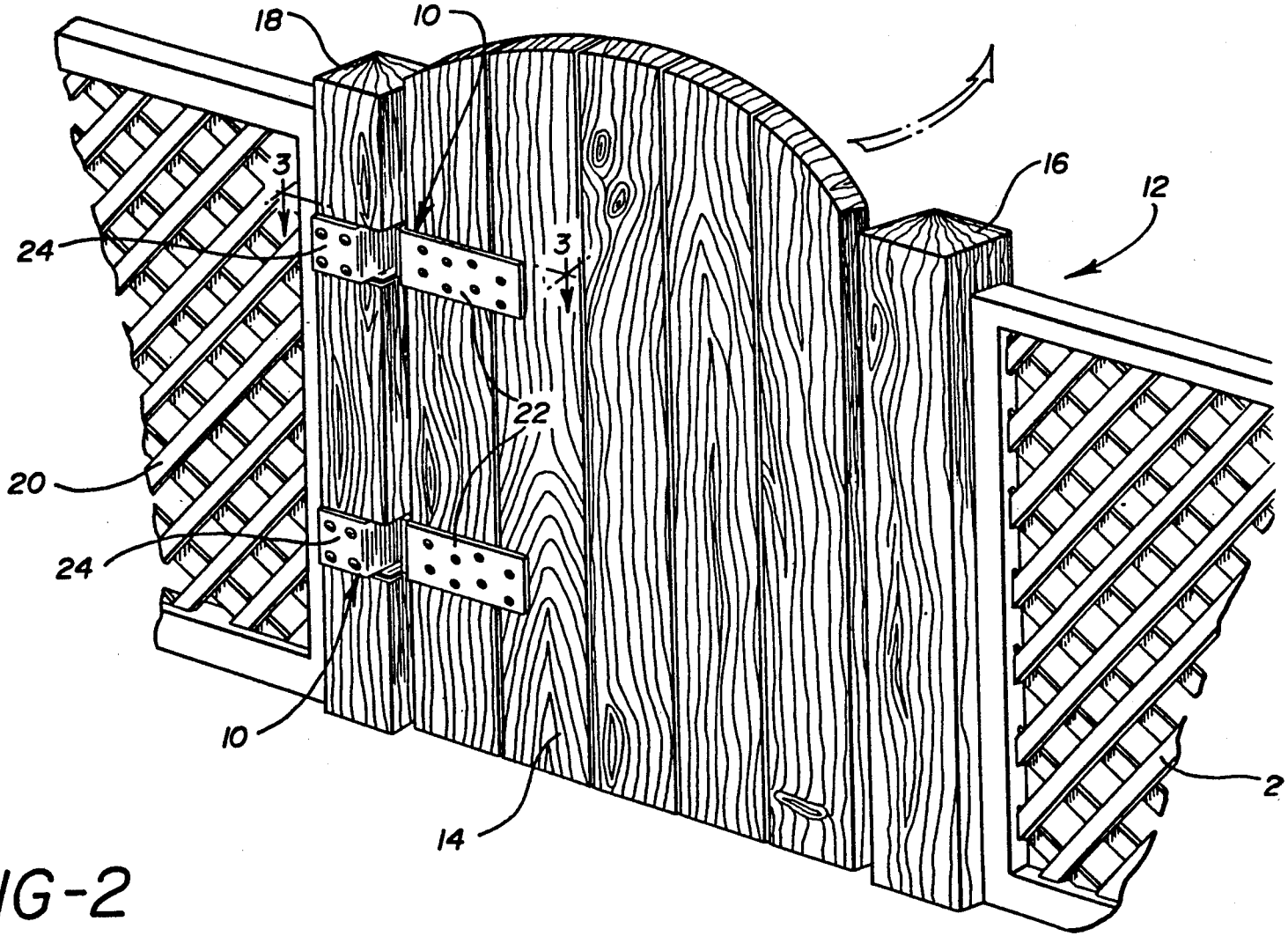
FIG. 2 is a perspective view of the gate hinge of this invention installed on a wooden gate and post therefore.

Referring to FIGS. 1–5, and in particular FIG. 2, the gate hinge 10 of this invention is used in conjunction with a wooden fence 12 which comprises a wooden gate 14 having posts 16 and 18 on either side of the gate 14. Attached to each of these posts is a fence portion 20. The gate hinge 10 comprises a moveable member 22 which is mounted to the wooden gate 14 and a non-movable member 24 which is mounted to wood post 18.

Figure 3:
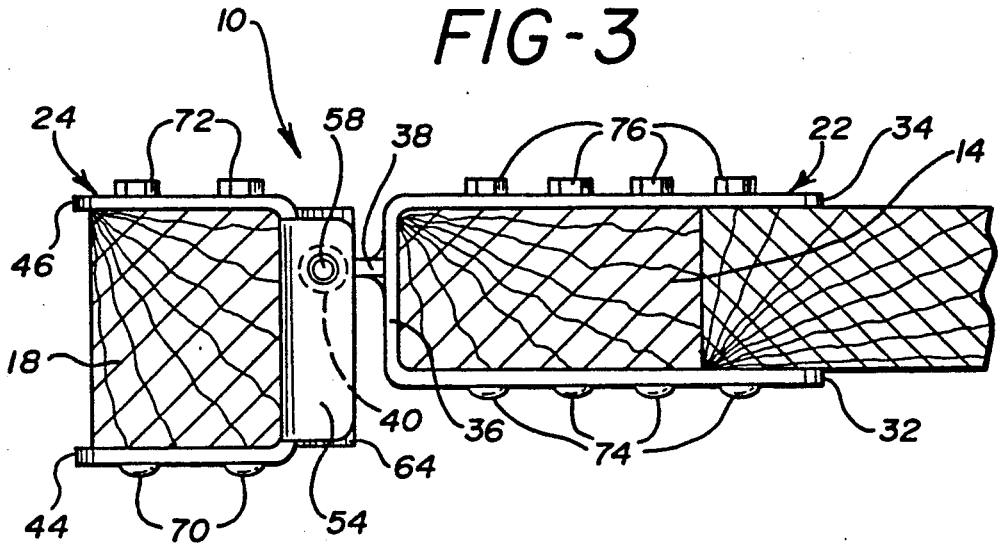
FIG. 3 is a partial cross sectional view along line 3—3 of FIG. 2.
Figure 4:
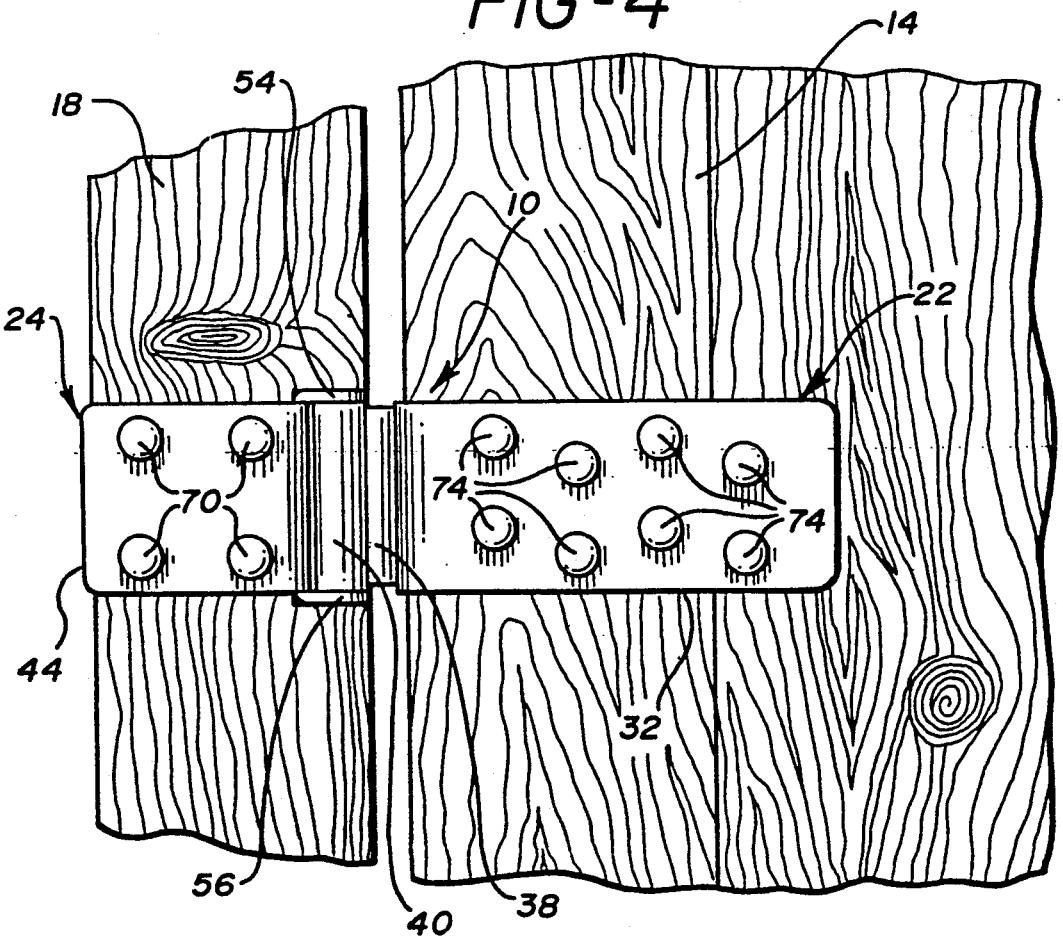
FIG. 4 is front view of the gate hinge of this invention.

Referring to FIGS. 1 and 3, the moveable member 22 comprises a stirrup member 26 adapted to be mounted to the gate 14 in a close fitting manner. A plurality of matching aligning bolt holes 28 and 30 are provided in leg 32 and 34, respectively, of the stirrup 26. At the side of the stirrup 26 attached to the web 36 connecting legs 32, 34 is an extension member 38 which is provided with an eye member 40 at the end thereof.

The non-movable member 24 comprises a stirrup member 42 adapted to be mounted to post 18 in a close fitting manner. Each leg 44 and 46 of the stirrup 42 has a plurality of matching, aligning holes 48 and 50, respectively. A web 52 connects stirrup legs 44, 46. Projecting from and along the top and bottom of web 52 are, respectively, lips 54, 56. Traversing these lips 54, 56 and mounted therebetween is a pivot pin 58 upon which the eye member 40 is mounted and pivots thereon.

Preferably pivot pin 58 is offset towards one stirrup leg 46 of the stirrup 42. The extension member 38 may be offset in a like manner toward stirrup leg 34. This offset permits the moveable member 22 to pivot fully in one direction and upon pivoting in the other direction the juncture of the web 36 and stirrup leg 32 contact web 52 to prevent the gate from moving in the other direction (See FIGS. 3 and 5).

Referring to FIG. 1, the post 18 upon which the non-movable member 24 is mounted, has a notch 60 therein which receives web 52 and lips 54, 56 thereon. The notch 60 has therein top and bottom surfaces 62 and 64. Preferably the surfaces 62, 64 of the notch 60 tightly enclose lips 54, 56 and provide support therefore. The depth of this notch 60 is such that the pin 58 is enclosed within post 18 as are a substantial portion of lips 54, 56.

In order to install the gate hinge 10 the notch 60 is cut of the proper size and depth. The non-movable member 24 is placed therein and holes 68 are drilled through post 18. A plurality of bolts 70 are passed through the stirrup legs 44, 46 and post 18 and tightened thereon with nuts 72. Subsequently, gate 14 is placed between stirrup legs 32, 34 and holes drilled through gate 14 to permit bolts 74 to pass there through in order to secure the gate thereon with nuts 76.

Preferably, as indicated in FIG. 2, at least two gate hinges are used, although there may be only one.

Figure 5:
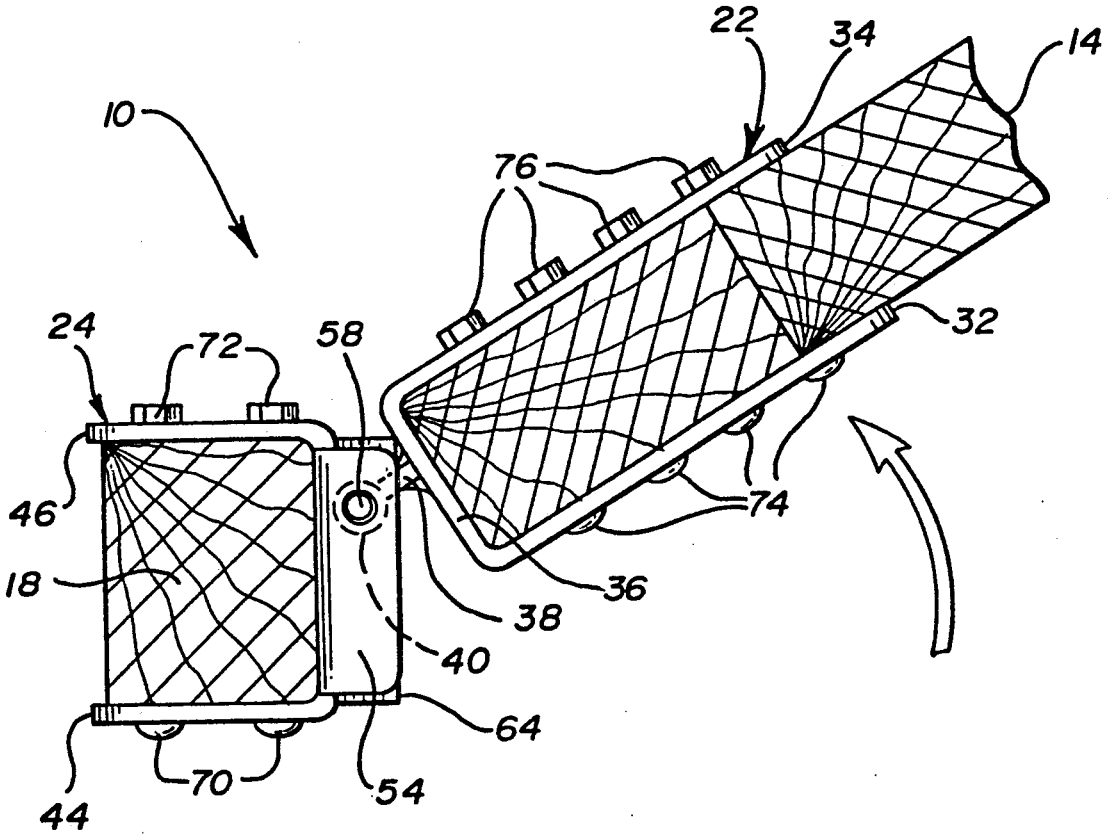
FIG. 5 is a cross sectional view taken along line 3—3 of FIG. 2 while the gate is being opened.

In use, the lips 54, 56 and top and bottom surfaces 62, 64 of notch 60 support and enclose the pivot pin 58 in such a manner that very little dirt and debris can get therein to deteriorate the hinge 10. Further, the bottom lip 56 and side 64 of notch 60 support the pin such that the gate 14 does not, over a period of time, begin to sag. The pin 58 and extension member 38 may be offset toward one of the stirrup legs 46, 34. As shown in FIG. 5 such an offset is sufficient to permit the gate 14 to completely open in one direction while when opened in the opposite direction the juncture of the web 52 and leg 44 meet the edge of lips 54, 56 or web 36 to prevent the gate from opening to any extent in the opposite direction.

A wood fence having a wooden gate and hinge according to this invention has numerous advantages, in particular, the pivot pin and eye are almost completely enclosed preventing debris, moisture, etc. from entering therein and deteriorating the mechanism, the combination of the post surrounding the lips and pin supports the gate in such a manner to avoid sagging and the offset of the pin and eye permits the gate to only open in one direction.

The foregoing description is deemed sufficiently detailed to enable a clear understanding to one skilled in the art of its construction and working. Many variations may however be made without departing from the spirit of the invention as now claimed.

What is claimed is:

1. A gate hinge assembly comprising:

A) a stationary post comprising:

1] a flat mid face and two adjacent flat side faces;

2] at least one notch formed in the flat mid face, said notch having upper and lower shoulders; and 3] a plurality of passages formed parallel to said flat mid face and substantially perpendicular to said adjacent side faces;

B) a non-moveable stirrup member fixed to said stationary post comprising:

1] a flat web and two adjacent flat stirrup legs, the flat web having a top and bottom surface;

2] upper and lower lips extending from the top and bottom of the flat web; said lower lip abutting and in registration with said lower shoulder of said notch in said stationary post; and 3] passage means in said upper and lower lips aligned for the mounting of a pivot pin;

C) a movable stirrup member adapted to be fixed to a gate comprising;

1] a flat web and two adjacent stirrup legs;

2] an extension member extending perpendicularly from said flat web and parallel to said stirrup legs;

3] said extension member in registration with said pivot pin passage means in said upper and lower lips of said non-moveable stirrup member; and 4] retaining means fixed to said extension member and adapted to receive the pivot pin to enable said movable stirrup member to pivot about said pivot pin with respect to said non-moveable stirrup member;

D) at least one of said passage means in said upper and lower lips aligned for the mounting of a pivot pin, and said extension member extending perpendicularly from said flat web being positioned closer to one of said stirrup legs; and E) said extension member extending an amount sufficient to enable clearance of said web of said movable stirrup member with relation to said web of said non-moveable stirrup member when pivoted in one direction only.

2. A gate hinge assembly as claimed in claim 1 wherein said stirrup legs of said stationary member further comprise:

A) a plurality of passages formed in each of said stirrup legs so as to be parallel to said flat web and substantially perpendicular to said stirrup legs;

B) said plurality of passages in said stirrup legs in registration to receive fastening means extending through said stirrup legs; and C) said plurality of passages in said stirrup legs in registration with said plurality of passages formed in said stationary post.

3. A gate hinge assembly as claimed in claim 1 wherein the passage means in said stationary member for mounting the pivot pin is positioned closer to one of said two stirrup legs.

4. A gate hinge assembly as claimed in claim 1 wherein each of said stirrup legs of said moveable member have a plurality of passages adapted to receive fastening means for securing said movable stirrup member to the gate; said plurality of passages in each of said stirrup legs in register with the plurality of passages in said other one of said stirrup legs.

5. A gate hinge assembly as claimed in claim 1 wherein said extension member extends an amount sufficient to allow clearance of said flat web of said movable stirrup member with relation to said flat web of said non-moveable stirrup member when pivoted toward the closer of the adjacent side stirrup legs and to cause interference between said flat web of said moveable stirrup member and said flat web of said non-moveable stirrup member when pivoted towards the further of said stirrup legs.

6. A gate hinge assembly as claimed in claim 1 wherein said retaining means for receiving the pivot pin comprise a tubular section.

7. A gate hinge comprising:

A) a sheet of material forming a non-moveable stirrup member adapted to be fixed to a stationary post comprising;

1] a flat web portion;

2] a first bend forming a first adjacent stirrup leg at one side of said flat web portion;

3] a second bend forming a second adjacent stirrup leg at the opposite side of said flat web portion;

4] a third bend perpendicular to said first and second bends forming an upper lip;

5] a fourth bend perpendicular to said first and second bends forming a lower lip;

6] said upper and lower lips extending from the top and bottom of the flat web away from the adjacent stirrup legs;

a) said lower lip adapted to abut and to be in register with a lower shoulder of a notch in a stationary post; and 7] passage means in said upper and lower lips aligned for the mounting of a pivot pin;

B) a moveable stirrup member adapted to be fixed to a gate comprising;

1] a sheet of material comprising:

a) a flat web portion;

b) a first bend forming a first adjacent side stirrup leg; and c) a second bend forming a second adjacent side stirrup leg;

2] an extension member extending perpendicularly from said flat web and parallel to said adjacent side stirrup legs;

3] retaining means fixed to said extension member and adapted to receive the pivot pin to enable said movable stirrup member to pivot about said pivot pin with respect to said non-moveable stirrup member;

a) said extension member in registration with said pivot pin passage means in said upper and lower lips of said non-moveable stirrup member;

C) at least one of said passage means in said upper and lower lips aligned for the mounting of a pivot pin, and said extension member extending perpendicularly from said flat web being positioned closer to one of said stirrup legs; and D) said extension member extending an amount sufficient to enable clearance of said web of said movable stirrup member with relation to said web of said non-moveable stirrup member when pivoted in one direction only.

8. A gate hinge as claimed in claim 7 further comprising a plurality of passages formed in each stirrup leg, said passages parallel to said flat web portion and substantially perpendicular to said stirrup legs.

9. A gate hinge as claimed in claim 8 wherein said plurality of passages in said stirrup legs are in registration so as to receive fastening means extending through said stirrup legs.

10. A gate hinge as claimed in claim 7 wherein the passage means for mounting the pivot pin is positioned closer to one of said two stirrup legs.

11. A gate hinge as claimed in claim 7 wherein said extension member extends an amount sufficient to allow clearance of said web of said moveable stirrup member with relation to said web of said non-moveable stirrup member when pivoted toward the closer of the adjacent side stirrup legs and to cause interference between said web of said moveable stirrup member and said web of said non-moveable stirrup member when pivoted towards the further of said stirrup legs.

* * * * *